US006694791B1

(12) United States Patent
Johnson et al.

(10) Patent No.: US 6,694,791 B1
(45) Date of Patent: Feb. 24, 2004

(54) METHOD OF SPIN FORMING AND PART MADE THEREOF

(75) Inventors: Gerald M. Johnson, Ney, OH (US); Leo C. Sholl, Oakwood, OH (US)

(73) Assignee: Hayes-Albion Corporation, Lebanon, NJ (US)

( * ) Notice: Subject to any disclaimer, the term of this patent is extended or adjusted under 35 U.S.C. 154(b) by 80 days.

(21) Appl. No.: 09/652,055

(22) Filed: Aug. 31, 2000

(51) Int. Cl.[7] ..... B21B 19/00

(52) U.S. Cl. ..... 72/91; 72/82; 72/68; 72/70; 72/92; 72/94; 72/115; 72/379.4

(58) Field of Search ..... 72/82, 91, 92, 72/94, 115, 125, 68, 70, 325, 379.2, 379.4

(56) References Cited

U.S. PATENT DOCUMENTS

| | | | | |
|---|---|---|---|---|
| 2,019,493 A | * | 11/1935 | Hothersall | 72/91 |
| 3,195,491 A | * | 7/1965 | Bulgrin et al. | 72/82 |
| 3,661,235 A | | 5/1972 | Harrison | |
| 4,294,097 A | * | 10/1981 | Gombas | 72/94 |
| 4,462,235 A | * | 7/1984 | King | 72/115 |
| 5,297,411 A | * | 3/1994 | Scrimshaw | 72/70 |
| 5,718,311 A | | 2/1998 | Victoria et al. | |
| 5,774,986 A | | 7/1998 | Nishimura et al. | |
| 5,836,431 A | | 11/1998 | Jackel | |

FOREIGN PATENT DOCUMENTS

| | | | | |
|---|---|---|---|---|
| JP | 57-112939 | * | 7/1982 | 72/82 |

* cited by examiner

*Primary Examiner*—Ed Tolan
(74) *Attorney, Agent, or Firm*—Dykema Gossett PLLC

(57) ABSTRACT

A method of cold forming a capped cylinder with geometrically spaced torsional engagement radial projections on an exterior side of the capped cylinder is provided. The method includes the step of striking a generally flat blank to form a drawn part having a first capped portion and a second cylindrical portion adjacent an open end of the capped cylinder, placing the drawn part with the capped portion into a die with a cylindrical cavity portion having a first diameter with radial projections extending to a second diameter greater than said first diameter; inserting into the drawn part open end a mandrel, and rotating said mandrel with respect to the drawn part to plastically deform the drawn part cylindrical portion radially outward into the die cylindrical portion to cold form the radial projections on the exterior side of the second cylindrical portion of the capped cylinder.

11 Claims, 4 Drawing Sheets

METHOD OF SPIN FORMING AND PART MADE THEREOF

FIELD OF THE INVENTION

The field of the present invention is that of a method of cold forming a capped cylinder having a cylindrical surface with geometrically spaced torsional engagement radial projections and the product made thereof. The field of the present invention also covers an apparatus utilized in the method above described.

BACKGROUND OF THE INVENTION

It is generally known in the art that a metal workpiece which is cold formed typically exhibits better strength characteristics than a metal workpiece which is hot formed. Accordingly, it has been known in the art to have a capped cylinder which is cold formed to provide a torsional force engaging member in an automotive vehicle transmission. When such a cold formed capped cylinder is to have gear teeth or splines along its outer cylindrical surface, typically, the capped cylinder is first cold formed and then the radially projecting splines or gear teeth are formed by removing metal upon an outer cylindrical surface of the capped cylinder by broaching. Although capped cylinders having splines or gear teeth which are first stamped and then broached or machined have performed in an acceptable manner, it is desirable to form such capped cylinders without having to go through the expense of the broaching operation. It is also desirable to form such a capped cylinder wherein the torsional engaging radial projections will have a greater strength than radial projections which have been formed by broaching. It is still another desire to have torsional force transferring radial projections which can meet exacting dimensional requirements without requiring machining.

SUMMARY OF THE INVENTION

To make manifest the above delineated desires, the revelation of the present invention is brought forth. The present invention brings forth a method of cold forming a capped cylinder having torsionally engaging radial projections along its cylindrical outer surface. The present invention includes piercing and drawing a circular blank into a capped portion and a cylindrical side portion. In the preferred embodiment of the present invention, the workpiece starts out as a flat disk of steel or other suitable material. The flat blank of steel is center pierced and drawn into a upper capped portion and a lower cylindrical portion. The drawn part is then restruck to further define the top into a generally flat capped portion. The top capped portion is connected to the lower cylindrical wall portion by an intermediate skirt portion. The top capped portion is then center pierced. Holes are also pierced for the location of appropriate fasteners. The top capped portion is then ironed to define a thickness of the capped portion. The workpiece is then placed over a spinning mandrel and placed within a die which has an inner surface with spline teeth. The spinning mandrel is axially brought up toward the die and then cold forms the spline upon the outer cylindrical surface of the workpiece by forcing the cylindrical side portion of the workpiece radially outwards toward the die. In a preferred embodiment, the spinning mandrel also forms an inner rim on the workpiece.

It is an object of the present invention to provide a method of cold forming a capped cylinder having geometrically spaced torsional engaging radial projections on a cylindrical outer surface.

It is an object of the present invention to provide a capped cylinder having a cylindrical portion with torsionally engaging radial projections.

It is a further object of the present invention to provide a spin forming machine which can, on a capped cylinder with a lower cylindrical portion, cold form torsionally engaging radial projections along an outer surface of the capped cylinder in combination with a die.

DETAILED DESCRIPTION OF THE PREFERRED EMBODIMENT

Figure 5:
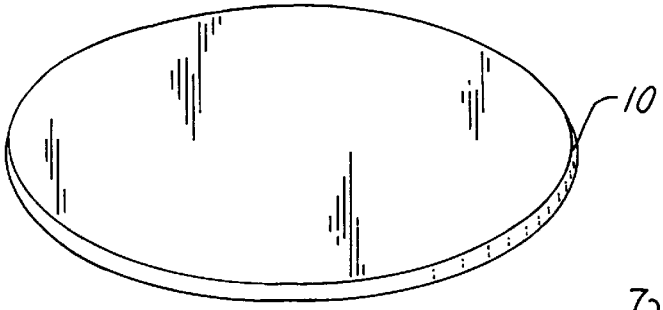
FIG. 5 is a perspective view of a flat blank which is the starting point for the workpiece made according to the present invention.
Figure 6:
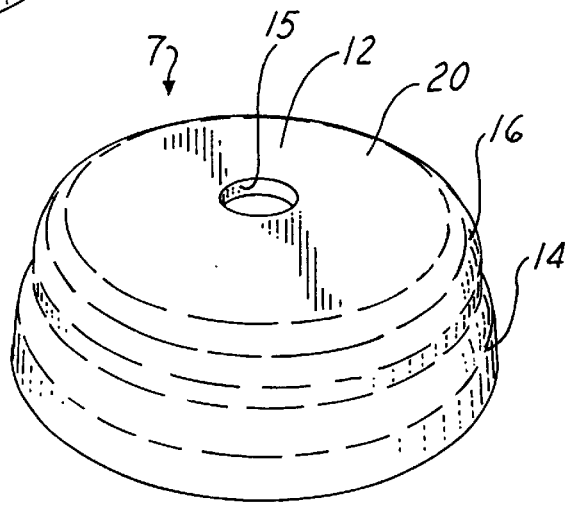
FIG. 6 is a perspective view of a workpiece according to the present invention, which has been pierced and drawn forming a capped portion and a lower cylindrical portion with an intermediate skirt.
Figure 7:
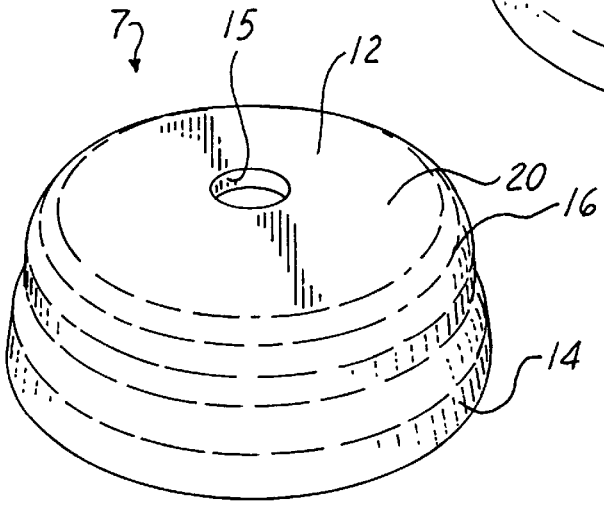
FIG. 7 is a perspective view of the workpiece shown in FIG. 6 which has been restruck.
Figure 10:
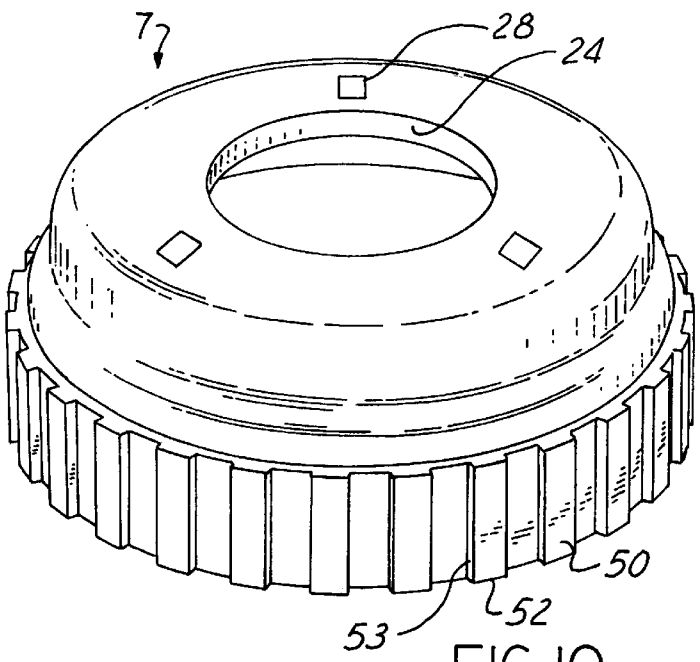
FIG. 10 is a view of the finished workpiece after placement between the spinning mandrel and die.
Figure 11:
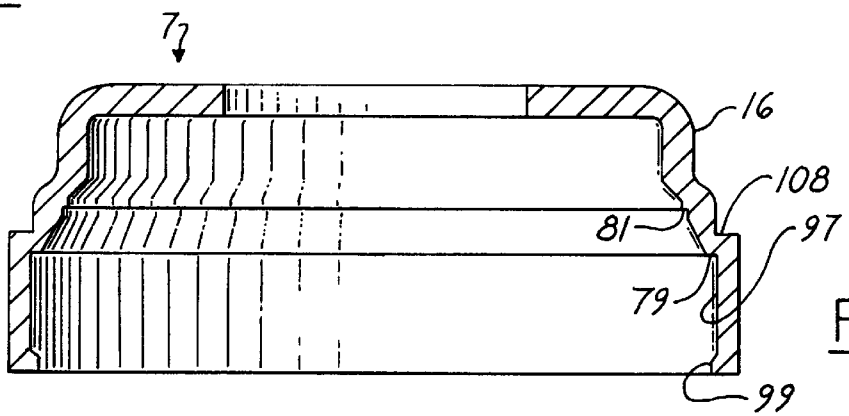
FIG. 11 is a sectional view taken through the workpiece shown in FIG. 10.

Referring to FIGS. 5, 10 and 11, a workpiece of a capped cylinder 7 of the present invention starts out as a circular blank 10. The circular blank 10 will typically be made from 1008 steel or other suitable metal and will typically have a thickness of 0.155±0.003 inches. The blank 10 is first struck and drawn to form a capped cylinder 7 as shown in FIG. 6. Approximately 600,000 lbs. of force will be used in the striking operation. Typically a synthetic deep draw lubricant will be utilized. The capped cylinder 7 has a capped portion 12 and the beginning of a generally cylindrical portion 14. A locationing aperture 15 is pierced out during the stamping operation. A skirt 16 connects the cylindrical portion 14 to a flat portion 20 of the capped portion 12. As shown in FIG. 7, the capped cylinder 7 is restruck to further define the capped portion 12, the skirt 16, and the cylindrical portion 14.

Figure 8:
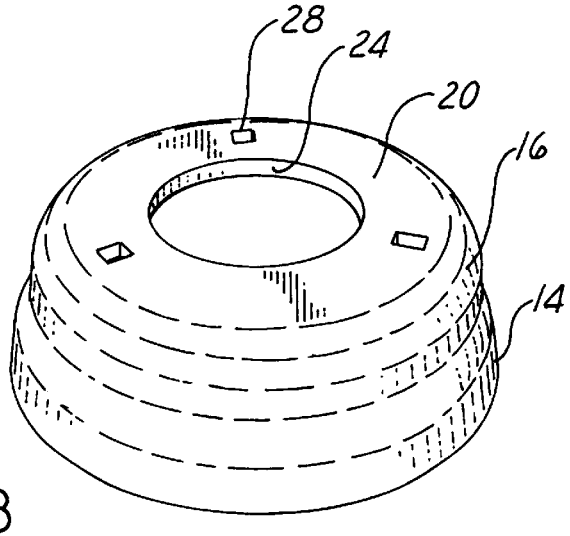
FIG. 8 is a perspective view of the workpiece shown in FIG. 7, after it has been center pierced and the fastener holes have been pierced therein.

Referring to FIG. 8, the capped cylinder 7 is center pierced to provide a central aperture 24 and fastener apertures 28.

Figure 9:
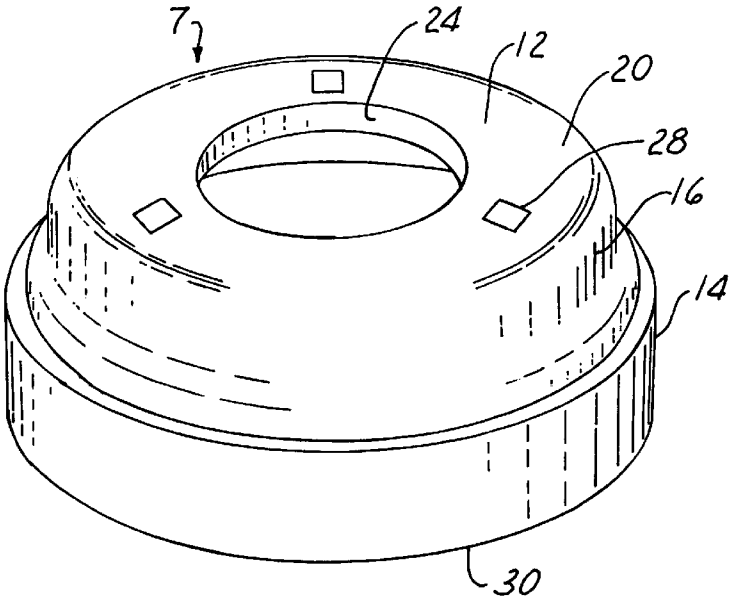
FIG. 9 is a view similar to that of FIG. 8, illustrating the workpiece after a final striking and nailing before placement within the oven.

As shown in FIG. 9 the capped cylinder 7 is restruck to iron the thickness of the generally cylindrical portion 14 of the capped cylinder 7 to a desired 0.092±0.003 in. thickness. The ironing operation will utilize a force of approximately 30% of the striking force of the initial drawing operation.

After the ironing operation, the capped cylinder 7 is annealed by heating the capped cylinder to 1560 degrees Fahrenheit in an atomosphere-controlled furnace. The capped cylinder 7 is then slowly cooled to ambient temperture.

The capped cylinder as shown in FIG. 9, is then brought to a grinding operation to grind off a lower part of the capped cylinder adjacent its open cylindrical end 30 to define the height between the bottom of the capped cylinder and its extreme top along the generally flat capped portion 20.

Referring additionally to FIGS. 1 through 4 the capped cylinder 7 as shown in FIG. 9 is then taken to a spinner machine 70 according to the present invention. The spinner machine 70 is utilized to form the geometrically spaced torsional engaging radial projections 50 (splines) on the capped cylinder 7. Spinner machine 70 has a mandrel 72. The mandrel 72 has a rotational axis 73 and can rotate approximately 240 rpms. The mandrel is powered by a 47 horsepower motor. The mandrel has a groove 74 and an engaging head 76. The mandrel has a lower shoulder 78 and an upper shoulder 80 to form a plurality of shoulders (79, 81 of FIG. 11) on an interior diametric surface of the capped cylinder 7. Mandrel 72 also has a top end portion 82 for supporting the generally flat portion 20 of the capped cylinder 7 during the operation of the spinner machine 70.

Figure 1:
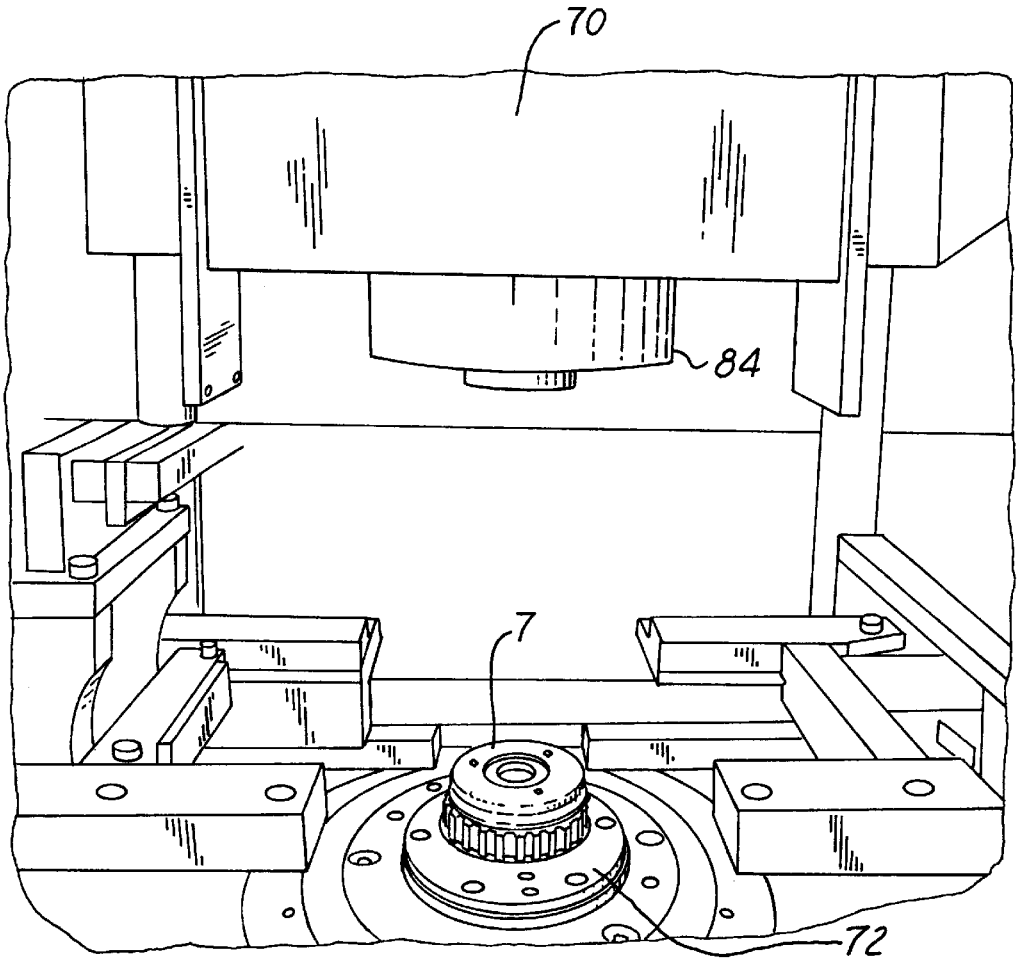
FIG. 1 is a perspective view of a spin forming machine according to the present invention illustrating an upper spring loaded die and a capped cylinder workpiece having a lower cylindrical surface with its open end placed on a spinning mandrel.
Figure 4:
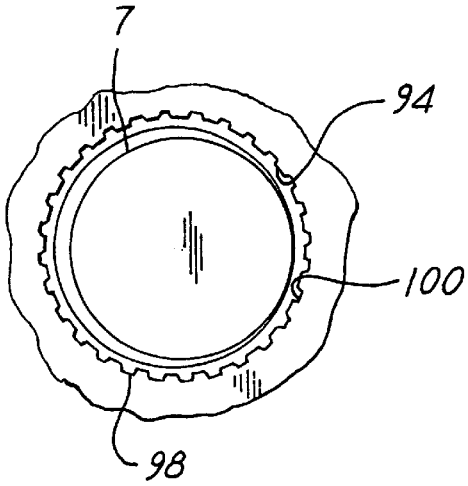
FIG. 4 is a sectional view taken along lines 4–4 of FIG. 3, which illustrate the workpiece and the spinning mandrel passing through the upper die.
Figure 2:
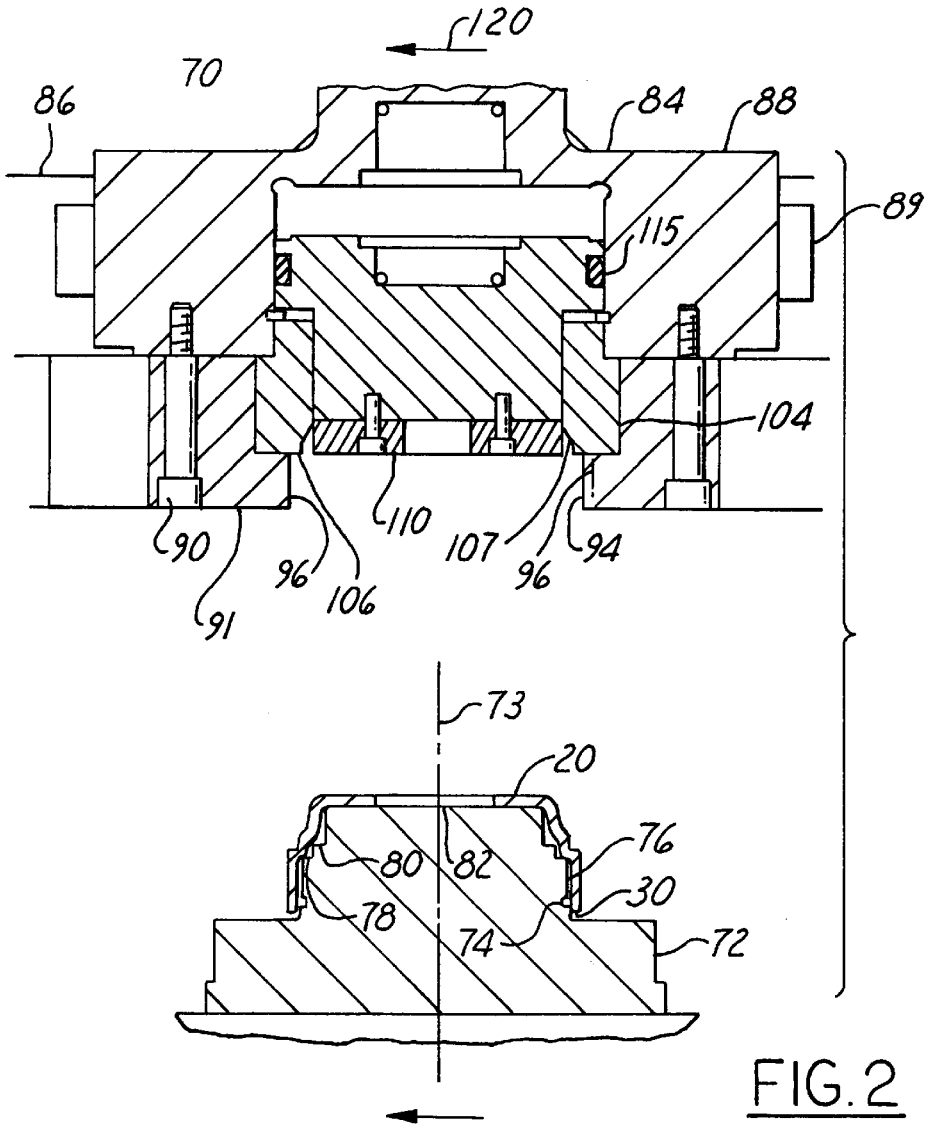
FIG. 2 is an exploded sectional view illustrating placement of the drawn capped cylinder workpiece upon the mandrel before the actual movement of the upper mounted die with the mandrel.
Figure 3:
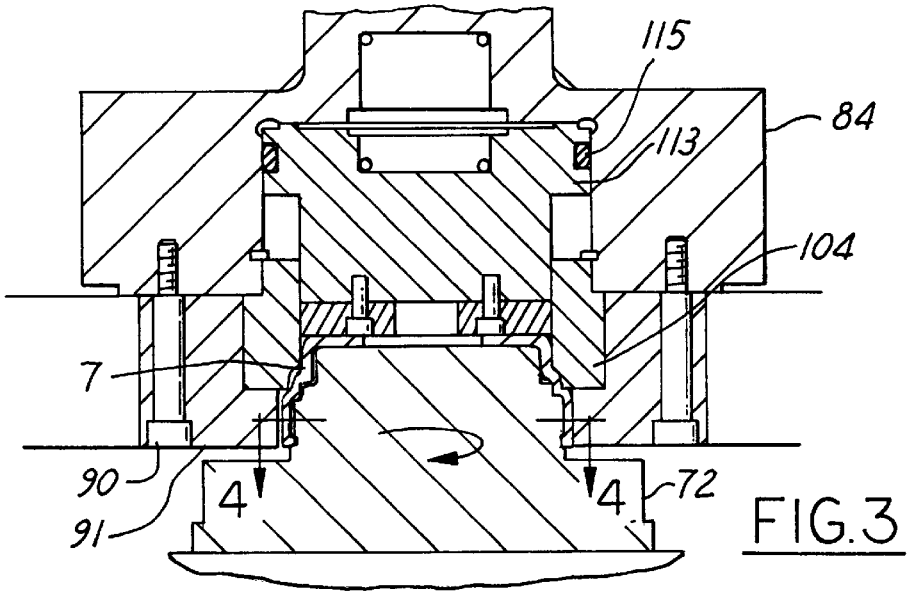
FIG. 3 is an operational view illustrating the engagement of the upper die with the spinning mandrel forming the workpiece according to the present invention.

The spinner machine 70 also has a die 84. The die unit 84 has an outer housing 86. The outer housing 86 by a series of roller bearings 89 rotatively mounts an inner housing 88. The inner housing 88 by a circular series of bolts 90 is connected with a first cylindrical portion 91 of the die. The cylindrical portion 91 has a cavity with a first diameter 94. The cavity has a series of radial projections 98 that extend to a second diameter 100, which is greater than the first diameter 94 (FIG. 4). Typically the die 84 will have the same number of radial projections as the capped cylinder 7. The die 84 also has a second portion 104 (FIG. 2) that has a point 106 for forming a shoulder 108 (FIG. 11) on the capped cylinder 7. The second portion 104 also has a surface area 107 which forms the skirt 16 of the capped cylinder into a desired shape. An axially movable third portion of the die 110 has a piston 113. The piston 113 has an annular seal 115. The space above the seal 115 has access to a source of pressurized fluid (hydraulic). The hydraulic fluid acting on the piston 113 can hold the piston 113 in a desired position or the hydraulic fluid can actuate the piston 113 towards the mandrel 72 to allow the capped cylinder 7 to be removed from the die 84 after the die 84 has acted upon the capped cylinder 7 as later described. The die third portion 110 has a wear plate 111 which makes contact with the generally flat portion 20 of the capped cylinder. As shown by arrow 120 in FIG. 2, the die inner housing 88 can also travel laterally to move the die 84 with respect to the mandrel 72.

As shown in FIG. 9, during operation, mandrel 72 is inserted into the open end 30 of capped cylinder 7 which is then placed within the spinner machine 70. The die is located concentric with the mandrel 72. The die 84 is brought vertically down with approximately 76,000 lbs. of force to hold the drawn part on the mandrel 72. As best shown in FIG. 4, die cavity first diameter 94 is somewhat larger than that of the capped cylinder cylindrical portion 14. The die 84 is then moved in the direction of arrow 120 approximately 0.488 inch and simultaneously the mandrel 72 has relative rotational movement with respect to the capped cylinder 7. The engaging head 76 of the mandrel forms a radial groove 97 on the interior surface diameter of the capped cylinder 7. The mandrel engaging head has a diameter approximately 0.977 inch less than the inner diameter of the capped clinder cylindrical portion. The mandrel 72 has a radial groove 74 which is provided for allowing space for the plastically deformed metal to fill into forming a rim 99 on the cylinder 7 (FIG. 11). The plastic deformation caused by the engaging head 76 causes the metal to be radially forced outward so that radial projections or splines 50 are formed on the outer diameter of the cylindrical portion 14 of the cylinder cap 7. Typically, the splines 50 will be 12% greater in strength than similar splines which are machined. The splines 50 of the present inventive process will typically have a surface finish equal or superior to those which are machined by conventional methods. As shown in FIG. 10, the splines 50 have a constant diameter portion 52 with generally radial sidewalls 53. However, in an alternative embodiment of the present invention, gear teeth can be provided. The drawn part will be rotated approximately 60 revolutions. The cycle time is usually approximately 14 seconds only.

While the best mode for carrying out the present invention has been described in detail, those familiar with the art to which this invention relates will recognize various alternative designs and embodiments for practicing the invention as defined by the following claims.

What is claimed is:

1. A method of cold forming a capped cylinder with a generally smooth surface on the interior thereof and geometrically spaced torsional engagement radial projections on the exterior surface of said capped cylinder, said method comprising the steps of:

striking a generally flat blank to form a drawn part having a generally flat capped portion, a generally right angle cylindrical portion adjacent an open end of said capped cylinder and a skirt joining said flat capped portion and said right angle cylindrical portion;

piercing a central aperture in said capped portion;

piercing said capped portion to provide a plurality of fastener attachment apertures which are located around the periphery of and are spaced from said central aperture;

further processing said drawn part by placing it in a spinner machine having a rotatively mounted die with a cylindrical die cavity having a first diameter with a series of radial die projections extending to a second diameter which is greater than said first diameter and having a driven mandrel without any teeth and having a rotational axis, with the mandrel having a lower shoulder, an upper shoulder, and a top end portion which is generally flat;

inserting the mandrel into the open end of said capped cylinder for supporting same, with the top end portion of said mandrel supporting the generally flat portion of the capped cylinder; and rotating said driven mandrel and axially and laterally moving said die and said mandrel with respect to one another, said mandrel engaging and plastically deforming the interior surface of said drawn part cylindrical portion by forcing the cylindrical side portion of the capped cylinder radially outwardly into said series of radial die projections of said die cavity to cold form said geometrically spaced torsional engagement radial projections on said exterior surface of said cylindrical portion of said capped cylinder while maintaining the interior surface thereof generally smooth.

2. A method of cold forming a capped cylinder as described in claim 1 further comprising the step of pressing said die and said mandrel axially toward one another.

3. A method of cold forming a capped cylinder as described in claim 1 further comprising the step of forming at least a first shoulder on an interior diameter of said capped cylinder with said mandrel.

4. A method of cold forming a capped cylinder as described in claim 3 further comprising the step of forming a plurality of shoulders within said interior diameter of said capped cylinder by said mandrel.

5. A method of cold forming a capped cylinder as described in claim 1 further comprising the step of forming a shoulder on an exterior diameter of said capped cylinder with said die.

6. A method of cold forming a capped cylinder as described in claim 1 further comprising the step of ironing said capped cylinder to a set thickness of said capped cylinder cylindrical portion.

7. A method of cold forming a capped cylinder as described in claim 1 further comprising the step of grinding said cylindrical portion of said capped cylinder adjacent said open end to set the height of said capped cylinder from said open end to an extreme end of said capped portion.

8. A method of cold forming a capped cylinder as described in claim 1 further comprising the step of forming a radial groove on an interior diameter of said capped cylinder with said mandrel.

9. A method of cold forming a capped cylinder as described in claim 8 further comprising the step of forming a rim on said interior diameter of said capped cylinder adjacent said open end with said mandrel.

10. A method of cold forming a capped cylinder as described in claim 1 further comprising the step of forming said radial projections of said capped cylinder to have a generally constant diameter portion and to have generally radially extending side walls.

11. A method of cold forming a capped cylinder as described in claim 1 further comprising the step of positioning a rotational center of said mandrel eccentrically with respect to a center of said die.

* * * * *